US012747901B2

(12) United States Patent
Ye

(10) Patent No.: US 12,747,901 B2
(45) Date of Patent: Sep. 29, 2026

(54) REFRIGERATION SYSTEM FOR A REFRIGERATOR AND A REFRIGERATOR THEREOF

(71) Applicant: Ningbo Bai-jia Electric Appliance Co., Ltd., Zhejiang (CN)

(72) Inventor: Junfa Ye, Cixi (CN)

(73) Assignee: Ningbo Bai-Jia Electric Appliance Co., Ltd., Cixi (CN)

( * ) Notice: Subject to any disclaimer, the term of this patent is extended or adjusted under 35 U.S.C. 154(b) by 174 days.

(21) Appl. No.: 18/884,963

(22) Filed: Sep. 13, 2024

(65) Prior Publication Data

US 2026/0009575 A1 Jan. 8, 2026

(30) Foreign Application Priority Data

Jul. 3, 2024 (CN) ..... 202421558792.X

(51) Int. Cl.

| | |
|---|---|
| ***F25C 1/24*** | (2018.01) |
| ***F25B 5/02*** | (2006.01) |
| ***F25C 5/182*** | (2018.01) |
| ***F25D 11/02*** | (2006.01) |
| ***F25D 13/00*** | (2006.01) |
| ***F25D 23/12*** | (2006.01) |

(Continued)

(52) U.S. Cl.

CPC ..... *F25C 1/24* (2013.01); *F25B 5/02* (2013.01); *F25C 5/182* (2013.01); *F25D 11/022* (2013.01); *F25D 13/00* (2013.01); *F25D 23/12* (2013.01); *F25D 31/007* (2013.01); *F25B 2400/0403* (2013.01); *F25B 2400/0411* (2013.01); *F25D 25/025* (2013.01); *F25D 2331/803* (2013.01); *F25D 2400/08* (2013.01)

(58) Field of Classification Search

CPC ..... F25B 5/02; F25B 2400/0403; F25B 2400/0411; F25C 1/24; F25C 5/182; F25D 11/022; F25D 13/00; F25D 23/12; F25D 31/007; F25D 25/025; F25D 2331/803; F25D 2400/08

See application file for complete search history.

(56) References Cited

U.S. PATENT DOCUMENTS 1,628,083 A * 5/1927 Vogt ..... F25D 25/024 62/407
2,812,642 A * 11/1957 Jacobs ..... F25D 17/065 62/180

(Continued)

FOREIGN PATENT DOCUMENTS

CN 217330357 U * 8/2022
CN 218672468 U * 3/2023

(Continued)

*Primary Examiner* — Ljiljana V. Ciric
(74) *Attorney, Agent, or Firm* — Wang Law Firm, Inc.

(57) ABSTRACT

A refrigeration system for a wine cooler comprises has a compressor; a condenser; an ice maker evaporator; a refrigerating chamber evaporator; a first capillary pipe; a second capillary pipe; a first solenoid valve; a second solenoid valve; a first three-way pipe having an inlet end and two outlet ends. The condenser communicates with an outlet end of the compressor and an inlet end of the first three-way pipe, and the two outlet ends of the first three-way pipe respectively communicate with the first solenoid valve and the second solenoid valve forming two passages.

11 Claims, 7 Drawing Sheets

(51) Int. Cl.
*F25D 25/02* (2006.01)
*F25D 31/00* (2006.01)

(56) References Cited

U.S. PATENT DOCUMENTS 3,477,243 A * 11/1969 Huck ..... F25D 15/00 62/298
3,650,122 A * 3/1972 Lieberman ..... A47B 77/08 62/298
3,804,482 A * 4/1974 Smith ..... F25D 17/06 211/74
4,280,335 A * 7/1981 Perez ..... F25D 16/00 62/332
4,637,222 A * 1/1987 Fujiwara ..... F25D 16/00 62/298
5,007,249 A * 4/1991 Van Druff, Jr. ..... A47F 3/0439 62/255
5,381,670 A * 1/1995 Tippmann ..... F25D 16/00 62/434
5,465,591 A * 11/1995 Cur ..... F25D 11/022 62/439
5,816,068 A * 10/1998 Oh ..... F25D 17/065 62/407
5,848,534 A * 12/1998 Stauffer ..... F25D 23/12 312/31.01
5,921,095 A * 7/1999 Lee ..... F25D 29/005 62/DIG. 13
5,957,557 A * 9/1999 Langer ..... F24C 15/08 312/236
6,343,483 B1 * 2/2002 Armstrong ..... G07F 9/105 62/255
6,601,394 B2 * 8/2003 Tatter ..... F25D 29/00 62/126
7,228,704 B2 * 6/2007 Rand ..... F25D 25/025 62/382
7,377,125 B2 * 5/2008 Seiden ..... F25D 11/02 62/443
7,380,410 B2 * 6/2008 Rand ..... F25D 23/021 312/301
8,042,355 B2 * 10/2011 Cur ..... F25B 25/00 62/434
8,061,153 B2 * 11/2011 Cur ..... F25D 17/02 62/186
8,161,760 B2 * 4/2012 Cur ..... F25D 17/065 62/185
8,245,524 B2 * 8/2012 Kuehl ..... F25D 13/04 62/185
8,336,321 B2 * 12/2012 Cur ..... F25D 17/045 312/236
8,336,322 B2 * 12/2012 Cur ..... F25D 17/02 62/185
8,720,222 B2 * 5/2014 Cur ..... F25D 11/022 62/519
8,925,338 B2 * 1/2015 Roekens ..... F25D 23/026 312/290
9,434,918 B1 * 9/2016 Narasimhan ..... C12H 1/16
9,605,884 B2 * 3/2017 Gomes ..... F25D 11/022
9,714,785 B2 * 7/2017 Cur ..... F25D 11/006
9,970,698 B2 * 5/2018 Gomes ..... F25D 11/022
D847,220 S * 4/2019 Strum ..... D15/89
10,845,097 B2 * 11/2020 Wang ..... F25B 49/022
11,098,929 B2 * 8/2021 Vijayan ..... F25B 5/00
11,920,860 B2 * 3/2024 Hong ..... F25D 23/028
12,098,877 B2 * 9/2024 Nichols ..... F25D 13/00
12,422,181 B2 * 9/2025 Lee ..... F25D 23/10
2008/0148745 A1 * 6/2008 Zhang ..... F25D 11/022 62/515
2008/0156007 A1 * 7/2008 Cur ..... F25B 5/02 62/175
2008/0156034 A1 * 7/2008 Cur ..... F25B 25/00 62/449
2012/0174607 A1 * 7/2012 Cur ..... F25B 25/00 62/132
2012/0186279 A1 * 7/2012 Cur ..... F25B 25/00 62/126
2012/0247127 A1 * 10/2012 Kuehl ..... F25D 17/065 62/333
2013/0098081 A1 * 4/2013 Cur ..... F25D 11/022 165/104.21
2019/0049169 A1 * 2/2019 Ciyanoglu ..... F25D 23/028
2024/0035726 A1 * 2/2024 Yang ..... F25C 1/24
2026/0009575 A1 * 1/2026 Ye ..... F25C 1/24

FOREIGN PATENT DOCUMENTS

CN 113924450 B * 5/2023 ..... F25D 17/02
DE 112016001980 T5 * 3/2018 ..... F25D 25/021
EP 2026021 A2 * 2/2009 ..... F25D 15/00
EP 3604988 A1 * 2/2020 ..... F25D 17/065
JP S632022 U * 1/1988
JP 2000258028 A * 9/2000
KR 101452762 B1 * 10/2014 ..... F25D 11/022
KR 20210112183 A * 9/2021 ..... F25D 25/025
KR 20210158189 A * 12/2021 ..... F25D 11/022
WO WO-2020253798 A1 * 12/2020 ..... F25C 1/045

* cited by examiner

REFRIGERATION SYSTEM FOR A REFRIGERATOR AND A REFRIGERATOR THEREOF

TECHNICAL FIELD OF THE INVENTION

The present invention relates to a refrigeration system for a wine cooler, and also relates to a wine cooler thereof.

BACKGROUND OF THE INVENTION

The wine cooler is a refrigeration device for cold storage and exhibition of foods, fruits and drinks. The wine cooler is smaller in size and occupies a smaller space to place than a common refrigerator, and is suitable for being placed in the living room or reception, being convenient to use. As more and more young people tend to make iced drinks with ice cubes, an additional ice maker is generally needed. As a result, two devices will occupy a large space. Therefore, some high-level wine coolers also have a freezing function to make ice.

For example, a Chinese Patent CN202304190U (patent No.: ZL201120397561.1) disclosed a wine cooler with a function of ice making, the wine cooler comprises a freezing chamber, a wine storage chamber and a refrigerating chamber, the freezing chamber is arranged in an upper part of the wine cooler, the wine storage chamber is arranged in a middle part of the wine cooler, and the refrigerating chamber is arranged in a lower part of the wine cooler; and, a partition plate is arranged between the wine storage chamber and the refrigerating chamber to separate them. This wine cooler is equivalent to a small refrigerator, which can make ice by placing an ice cube tray in the freezing chamber, but is unable to directly make ice by the wine cooler itself. Since this wine cooler has the freezing chamber and the refrigerating chamber, a high-power compressor is required, thus increasing the cost and power consumption.

Therefore, the design of a wine cooler with a specialized ice making function, low cost and low energy consumption is a technical problem to be urgently solved by those skilled in the art.

SUMMARY OF THE INVENTION

It is a first object of the present invention to provide a refrigeration system for a wine cooler with a specialized ice making function, and the refrigeration system has a low cost and a low energy consumption.

For achieving the first object, the refrigeration system for the wine cooler comprises a compressor having an inlet end and an outlet end; a condenser; an ice maker evaporator; a refrigerating chamber evaporator; a first capillary pipe; a second capillary pipe; a first solenoid valve; a second solenoid valve; a first three-way pipe having an inlet end and two outlet ends; wherein, the condenser communicates with the outlet end of the compressor and the inlet end of the first three-way pipe, and the two outlet ends of the first three-way pipe respectively communicate with the first solenoid valve and the second solenoid valve forming two passages: a first passage and a second passage; in the first passage, the first solenoid valve communicates with the first capillary pipe, the first capillary pipe communicates with the ice maker evaporator, and the ice maker evaporator communicates with the inlet end of the compressor; in the second passage, the second solenoid valve communicates with the second capillary pipe, the second capillary pipe communicates with the refrigerating chamber evaporator, and the refrigerating chamber evaporator communicates with the inlet end of the compressor.

As an improvement, the refrigeration system further comprises a second three-way pipe having two inlet ends and an outlet end, the two inlet ends of the second three-way pipe respectively communicate with the ice maker evaporator and the refrigerating chamber evaporator, the outlet end of the second three-way pipe communicates with the inlet end of the compressor. The three-way pipe facilitates a connection of the ice maker evaporator, the refrigerating chamber evaporator and the compressor.

Preferably, the condenser communicates with the inlet end of the first three-way pipe through a filter. The filter removes impurities and moisture in a refrigerant so as to improve the refrigerating effect.

Preferably, the refrigeration system further comprising a third solenoid valve, the outlet end of the compressor communicates with an inlet end of ice maker evaporator through the third solenoid valve forming a third passage. The third passage can directly convey the refrigerant in the compressor not cooled by the condenser to the ice maker evaporator through the third solenoid valve, so that ice cubes are deiced and separated from a columnar part of the ice maker evaporator, being beneficial for quickly taking ice cubes.

Preferably, the refrigeration system further comprises a third three-way pipe having an inlet end and two outlet ends, the inlet end of the third three-way pipe communicates with the outlet end of the compressor, and the two outlet ends of the third three-way pipe respectively communicate with the third solenoid valve and the condenser. The three-way pipe facilitates a connection of the ice maker evaporator, the refrigerating chamber evaporator and the compressor.

Compared with the prior art, the refrigeration system for the wine cooler has the following advantages. Two independent and parallel refrigeration passages are formed, one of which provides refrigeration for the ice maker and is controlled by the first solenoid valve, and the other one of which provides refrigeration for the freezing chamber and is controlled by the second solenoid valve. In a normal state of the wine cooler, the first solenoid valve is closed, the second solenoid valve is opened, and the compressor only provides refrigeration for the refrigerating chamber evaporator. When it is necessary to make ice, the first solenoid valve is opened, the second solenoid valve is closed, and the compressor only provides refrigeration for the ice maker evaporator. Thus, functions of the wine cooler can be realized without using a high-power compressor, and the cost and energy consumption can be reduced. In addition, the wine cooler has an independent ice making function to satisfy a demand for ice cubes.

It is a second object of the present invention to provide a wine cooler with a specialized ice making function, and the wine cooler has a reasonable configuration, and a low energy consumption.

For achieving the second object, the wine cooler comprises a machine housing having a refrigerating chamber inside; a door disposed in front of the refrigerating chamber to cover the refrigerating chamber; an ice maker located above the refrigerating chamber; an above-stated refrigeration system disposed inside the machine housing; wherein, the ice maker evaporator of the refrigeration system is disposed inside the ice maker and at a top of the ice maker, the refrigerating chamber evaporator of the refrigeration system is disposed behind the refrigerating chamber.

Preferably, the ice maker comprises an ice containing drawer capable of being extended or retracted, and a water storage box capable of being turned over which is disposed above the ice containing drawer; the ice maker evaporator is located above the water storage box, and the ice containing drawer is disposed below the water storage box, the ice containing drawer has one or more water leakage holes at a bottom of the ice containing drawer. The ice maker is of a drawer type. When it is necessary to take ice cubes, it is only necessary to draw the ice containing drawer out.

Preferably, a functional module is disposed above the refrigerating chamber inside the machine housing, the functional module is a disinfection cabinet module or a cigar cabinet module. The disinfection cabinet module can be used for disinfection of cups, and the cigar cabinet module can be used for storage of cigars.

Preferably, the functional module is a disinfection cabinet module which is a drawer-type disinfection cabinet. Compared with a door-type disinfection cabinet, the drawer-type disinfection cabinet is more convenient to take cups.

Preferably, a partition plate is disposed inside the refrigerating chamber to divide the refrigerating chamber into an upper area for storing red wines and a lower area for storing drinks. Since the compressor and the condenser of the refrigeration system are disposed behind the refrigerating chamber inside the machine housing, the refrigerating chamber has a shallow longitudinal depth. The refrigerating chamber is divided into the upper storage area for storing red wines and the lower area for storing drinks by the partition plate. The upper storage area for storing red wines has a relatively deeper longitudinal depth and is capable of storing red wines flatly, while the lower area for storing drinks with a shallower longitudinal depth is suitable for storing small bottles of canned drinks. Thus, the cold storage space is fully utilized.

Compared with the prior art, the wine cooler of the present invention has a conventional refrigerating function and also a specialized ice making function. Moreover, the ice maker is arranged above the machine housing and is completely independent of the refrigerating chamber, so that it is convenient to take ice cubes. In addition, by using the refrigeration system described above, the functions of the wine cooler can be realized without using a high-power compressor, and the cost and energy consumption can be reduced.

DETAILED DESCRIPTION OF THE INVENTION

The present invention will be further described below in detail by embodiments with reference to the accompanying drawings.

Figure 1:
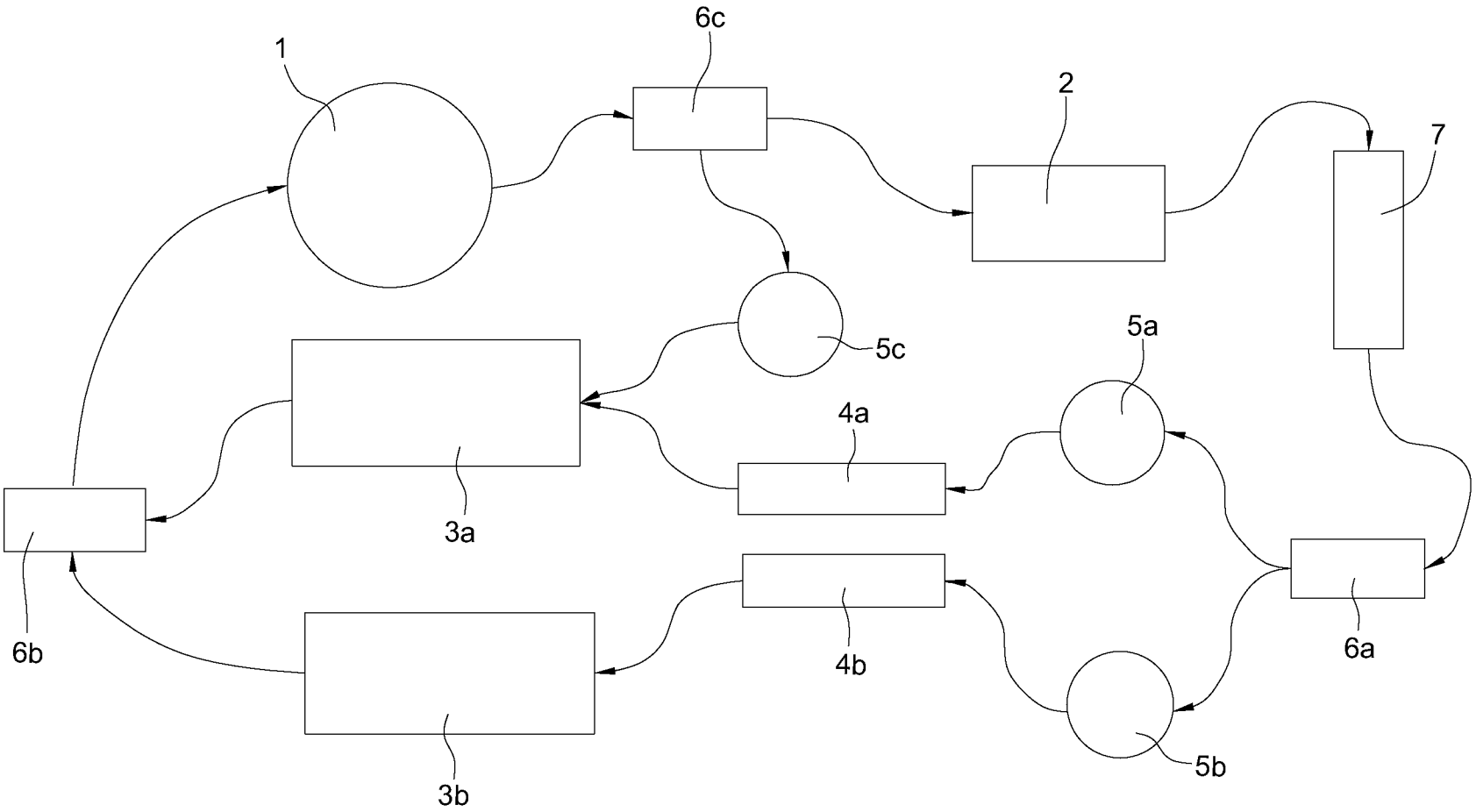
FIG. 1 is a connection diagram of functional modules of a refrigeration system for a wine cooler according to an embodiment of the present invention.
Figure 2:
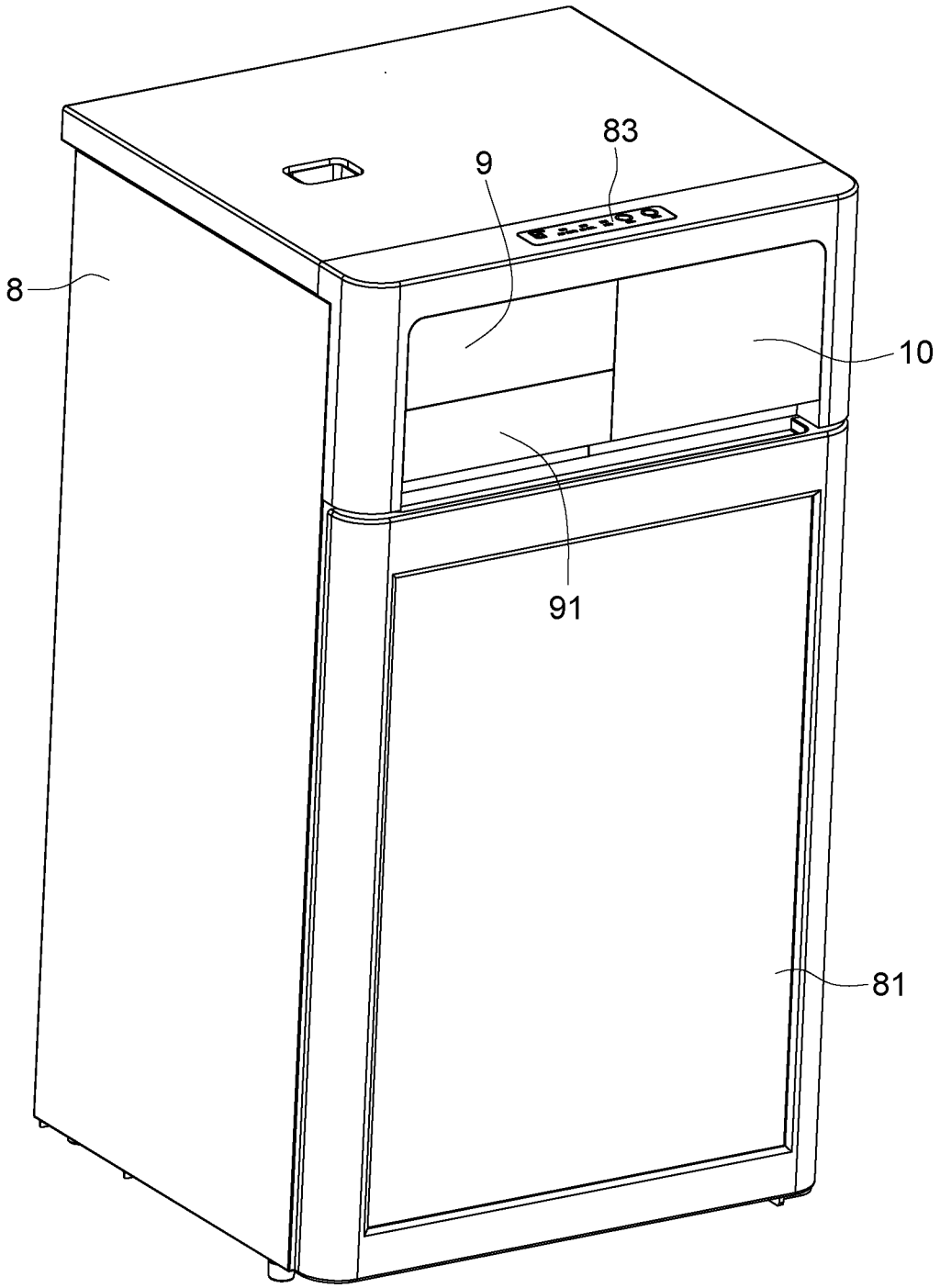
FIG. 2 is a perspective view of the wine cooler according to an embodiment of the present invention when view from the front.
Figure 3:
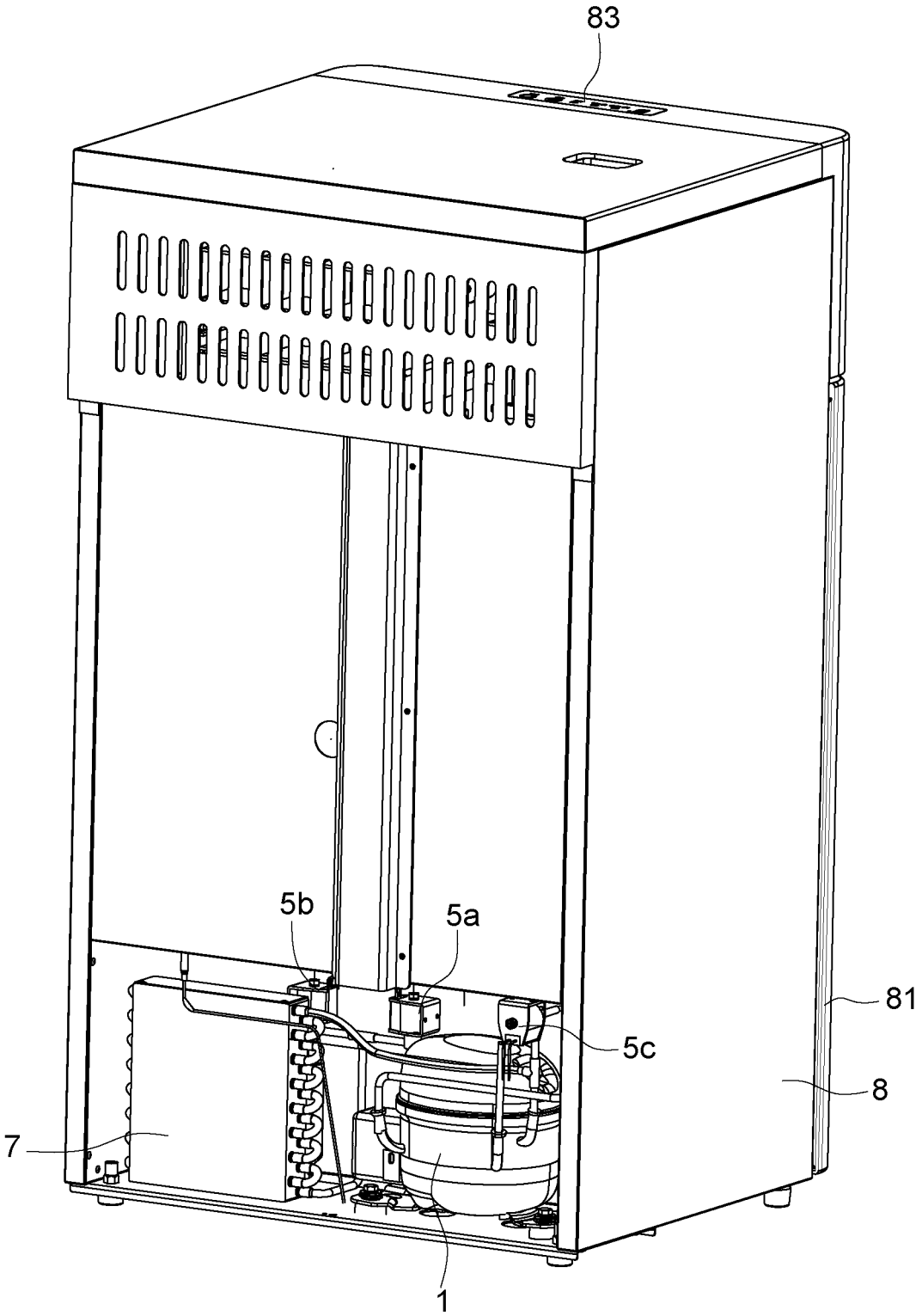
FIG. 3 is a perspective view of the wine cooler according to the embodiment of the present invention when view from the back.
Figure 4:
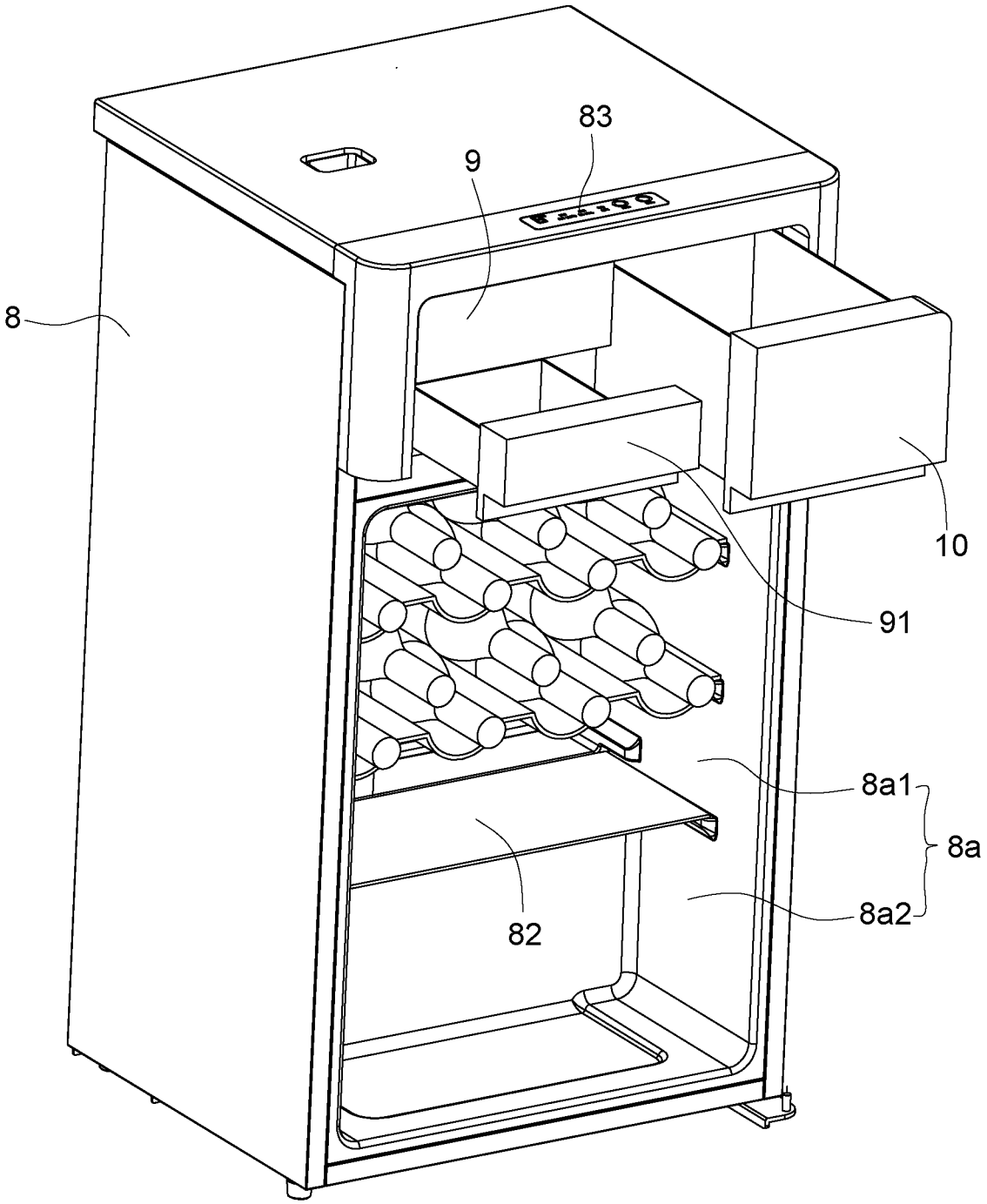
FIG. 4 is a perspective view of the wine cooler according to the embodiment of the present invention when a door is removed (the drawer is in an extended state)
Figure 5:
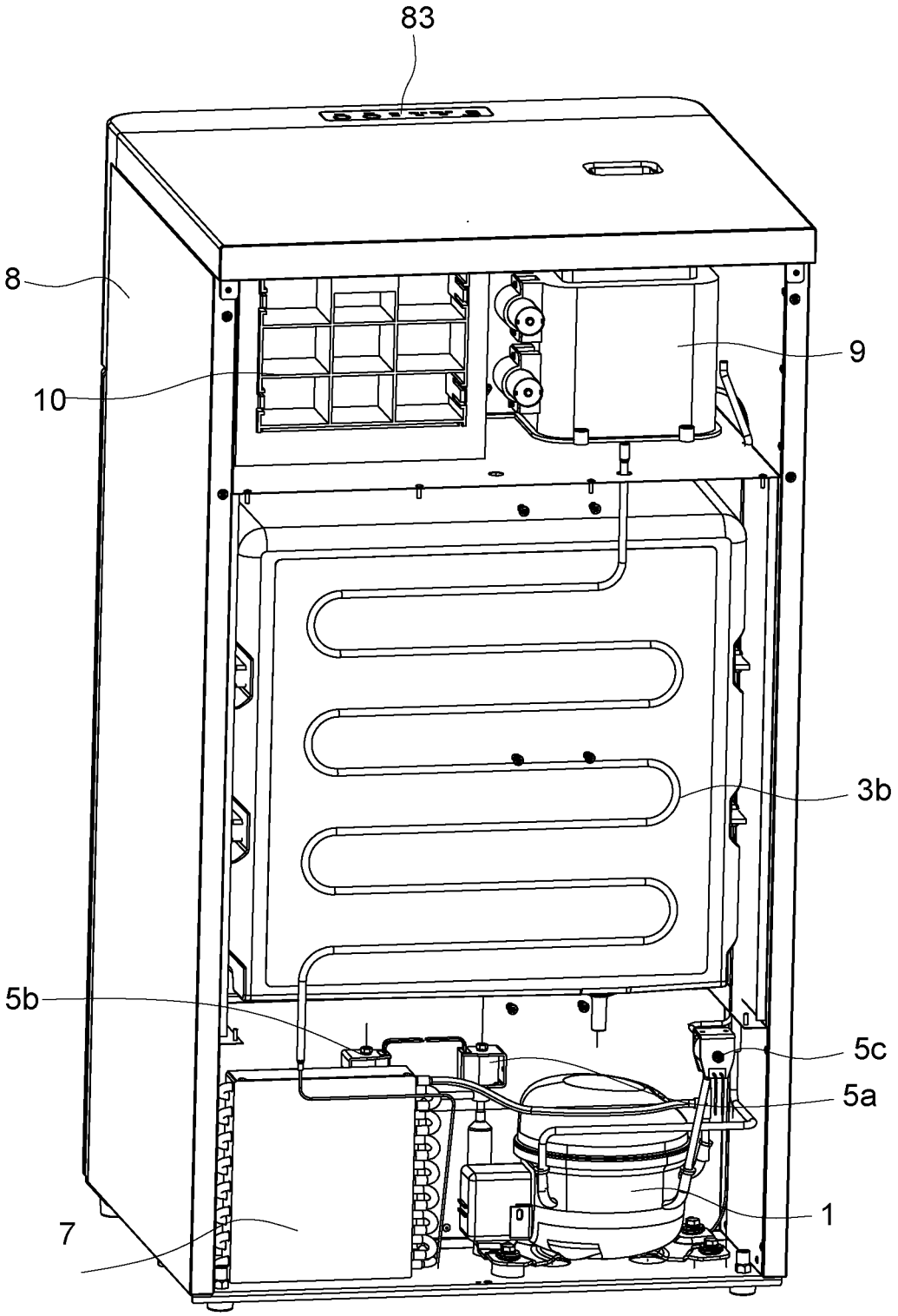
FIG. 5 is a perspective view of the wine cooler according to the embodiment of the present invention when a rear cover is removed.
Figure 6:
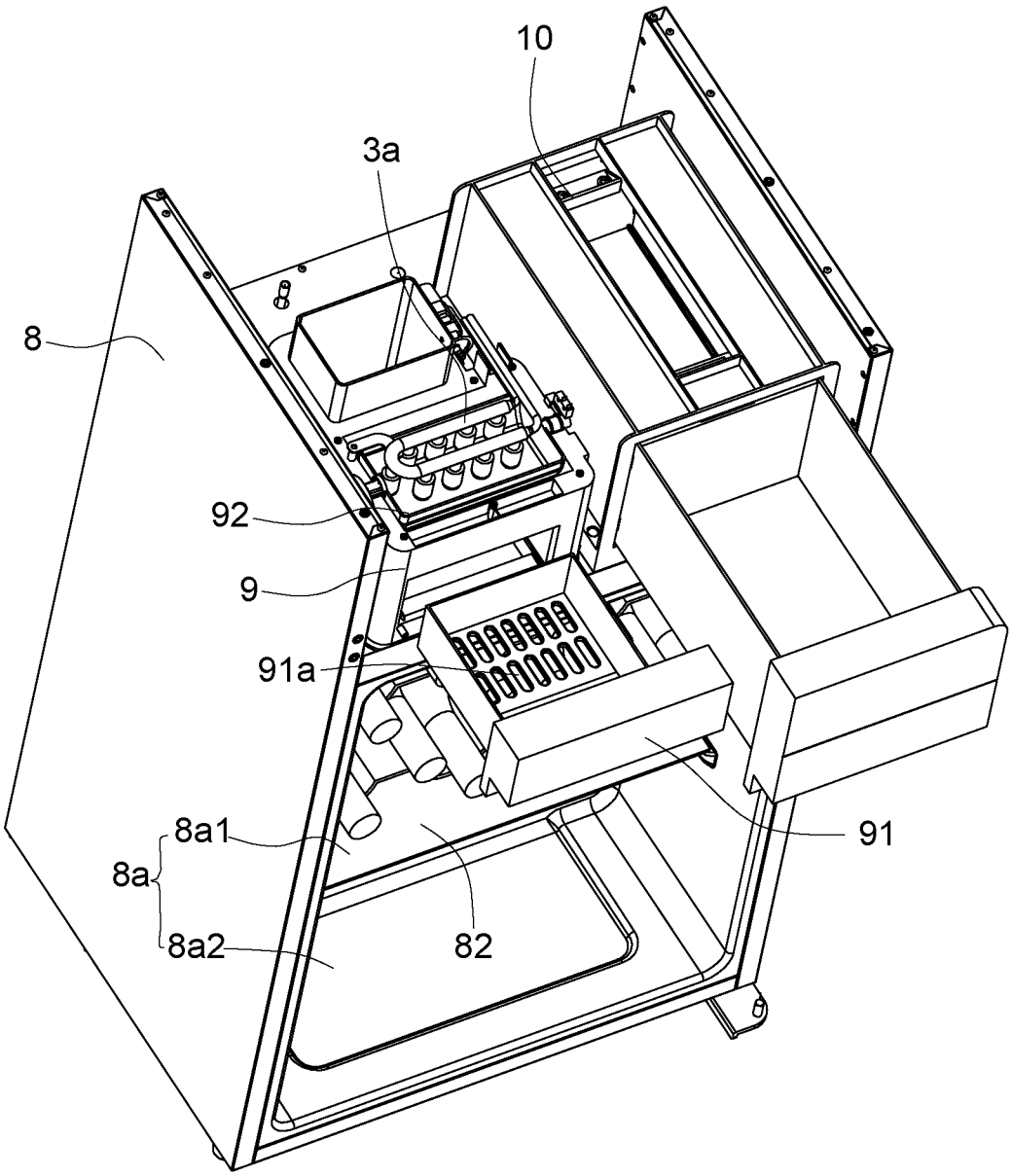
FIG. 6 is a perspective view of the wine cooler according to the embodiment of the present invention when the door, the rear cover and a roof are removed (the drawer is in the extended state).
Figure 7:
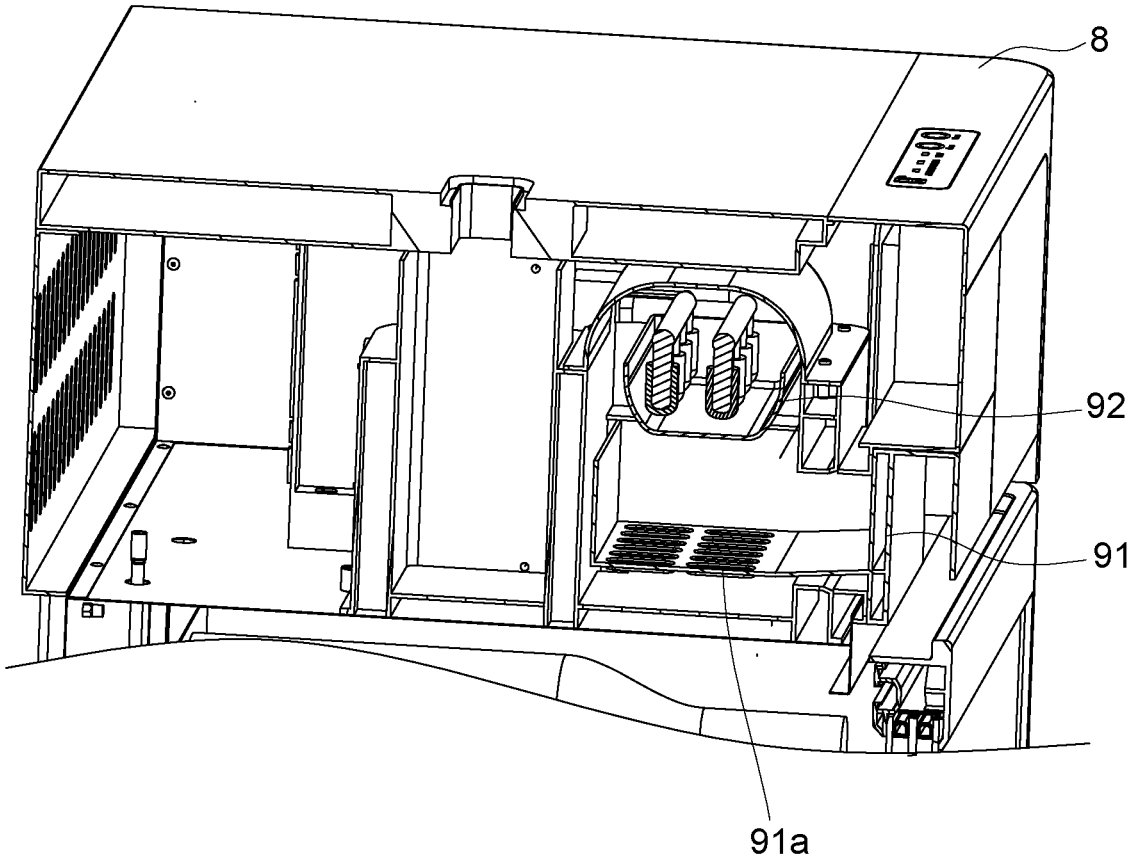
FIG. 7 is a sectional view of the wine cooler according to the embodiment of the present invention when the drawer is in the retracted state.

FIG. 1 shows a preferred embodiment of a refrigeration system for a wine cooler.

The refrigeration system for the wine cooler comprises a compressor 1 having an inlet end and an outlet end, a condenser 2, an ice maker evaporator 3*a*, a refrigerating chamber evaporator 3*b*, a first capillary pipe 4*a*, a second capillary pipe 4*b*, a first solenoid valve 5*a*, a second solenoid valve 5*b*, and a first three-way pipe 6*a* having an inlet end and two outlet ends.

The condenser 2 communicates with the outlet end of the compressor 1 and the inlet end of the first three-way pipe 6*a*, and the two outlet ends of the first three-way pipe 6*a* respectively communicate with the first solenoid valve 5*a* and the second solenoid valve 5*b* forming two passages: a first passage and a second passage. In the first passage, the first solenoid valve 5*a* communicates with the first capillary pipe 4*a*, the first capillary pipe 4*a* communicates with the ice maker evaporator 3*a*, and the ice maker evaporator 3*a* communicates with the inlet end of the compressor 1; in the second passage, the second solenoid valve 5*b* communicates with the second capillary pipe 4*b*, the second capillary pipe 4*b* communicates with the refrigerating chamber evaporator 3*b*, and the refrigerating chamber evaporator 3*b* communicates with the inlet end of the compressor 1.

The refrigeration system further comprises a second three-way pipe 6*b* having two inlet ends and an outlet end, the two inlet ends of the second three-way pipe 6*b* respectively communicate with the ice maker evaporator 3*a* and the refrigerating chamber evaporator 3*b*, the outlet end of the second three-way pipe 6*b* communicates with the inlet end of the compressor 1. The condenser 2 communicates with the inlet end of the first three-way pipe 6*a* through a filter 7.

The refrigeration system further comprises a third solenoid valve 5*c*, the outlet end of the compressor 1 communicates with an inlet end of ice maker evaporator 3*a* through the third solenoid valve 5*c* forming a third passage. The refrigeration system further comprises a third three-way pipe 6*c* having an inlet end and two outlet ends, the inlet end of the third three-way pipe 6*c* communicates with the outlet end of the compressor 1, and the two outlet ends of the third three-way pipe 6*c* respectively communicate with the third solenoid valve 5*c* and the condenser 2.

The specific control mode may be described as follows. In a normal (refrigerating) state of the wine cooler, the first solenoid valve 5*a* and the third solenoid valve 5*c* are closed, the second solenoid valve 5*b* is opened, and the compressor 1 only provides refrigeration for the refrigerating chamber evaporator 3*b*. When it is necessary to make ice, the first solenoid valve 5*a* is opened, the second solenoid valve 5*b* and the third solenoid valve 5*c* are closed, and the compressor 1 only provides refrigeration for the ice maker evaporator 3*a*. Thus, functions of the wine cooler can be realized without using a high-power compressor, and the cost and energy consumption can be reduced. When it is necessary to deice, the first solenoid valve 5*a* and the second solenoid valve 5*b* are closed, the third solenoid valve 5*c* is opened, a refrigerant in the compressor 1 not cooled by the condenser can be directly conveyed to the ice maker evaporator 3*a* through the third solenoid valve 5*c*, so that ice cubes are deiced and separated from a columnar part of the ice maker evaporator 3*a*, being beneficial for quickly taking ice cubes. Generally, the third solenoid valve 5*c* will be automatically closed after being opened for 5 seconds. After the ice making capacity satisfies a pre-set demand, the wine cooler will return to the normal state.

FIGS. 2 to 7 show a preferred embodiment of a wine cooler.

The wine cooler comprises a machine housing 8 having a refrigerating chamber 8*a* inside; a door 81 disposed in front of the refrigerating chamber 8*a* to cover the refrigerating chamber 8*a*; an ice maker 9 located above the refrigerating chamber 8*a*; and a refrigeration system in the above-stated embodiment disposed inside the machine housing 8.

The ice maker 9 comprises an ice containing drawer 91 capable of being extended or retracted, and a water storage box 92 capable of being turned over which is disposed above the ice containing drawer 91. The ice maker evaporator 3*a* is located above the water storage box 92, and the ice containing drawer 91 is disposed below the water storage box 92, the ice containing drawer 91 has one or more water leakage holes 91*a* at a bottom of the ice containing drawer 91. The ice maker 9 further comprises a water suction pump for pumping excess water below the ice maker 9 to the water storage tank 92, and a turning of the water storage tank 92 is controlled by a motor.

A functional module 10 is disposed above the refrigerating chamber 8*a* inside the machine housing 8, the functional module 10 is a disinfection cabinet module or a cigar cabinet module. The functional module 10 is a disinfection cabinet module which is a drawer-type disinfection cabinet. A control panel 83 is arranged on a top surface of the machine housing 8.

A partition plate 82 is disposed inside the refrigerating chamber 8*a* to divide the refrigerating chamber 8*a* into an upper area 8*a*1 for storing red wines and a lower area 8*a*2 for storing drinks.

This wine cooler of the present invention not only has a conventional refrigerating function, but also has a specialized ice making function and a cup disinfection function. The ice maker 9 and the functional module 10 are disposed at a top of the machine housing and completely independent of the refrigerating chamber 8*a*, so it is convenient to take ice cubes.

It should be noted that in the description of the present invention, the terms "front, back", "left, right", "inside, outside", "up, down", etc. to describe a direction or position based on the accompanying drawings are only used for describe the present invention and simplify the description, instead of indicating that devices or elements must have particular orientation or must be constructed and operated in a particular orientation. So that these terms indicating directions should not be used as restrictions. The verbs "connect" should be understood broadly. For example, it can be fixedly connected or detachably connected or integrally connected or directly connected or connected through intermediate mediums or connected in two members. For technicians in this field, the specific meanings of these terms used in the present invention can be understood in specific contexts.

The invention claimed is:

1. A refrigeration system for a wine cooler, comprising:

a compressor (1) having an inlet end and an outlet end;

a condenser (2);

an ice maker evaporator (3*a*);

a refrigerating chamber evaporator (3*b*);

a first capillary pipe (4*a*);

a second capillary pipe (4*b*);

a first solenoid valve (5*a*);

a second solenoid valve (5*b*);

a third solenoid valve (5*c*); and a first three-way pipe (6*a*) having an inlet end and two outlet ends;

wherein, the condenser (2) communicates with the outlet end of the compressor (1) and the inlet end of the first three-way pipe (6*a*), and the two outlet ends of the first three-way pipe (6*a*) respectively communicate with the first solenoid valve (5*a*) and the second solenoid valve (5*b*) forming two passages: a first passage and a second passage;

in the first passage, the first solenoid valve (5*a*) communicates with the first capillary pipe (4*a*), the first capillary pipe (4*a*) communicates with the ice maker evaporator (3*a*), and the ice maker evaporator (3*a*) communicates with the inlet end of the compressor (1);

in the second passage, the second solenoid valve (5*b*) communicates with the second capillary pipe (4*b*), the second capillary pipe (4*b*) communicates with the refrigerating chamber evaporator (3*b*), and the refrigerating chamber evaporator (3*b*) communicates with the inlet end of the compressor (1); and the outlet end of the compressor (1) communicates with an inlet end of the ice maker evaporator (3*a*) through the third solenoid valve (5*c*) forming a third passage.

2. The refrigeration system of claim 1, further comprising a second three-way pipe (6*b*) having two inlet ends and an outlet end, the two inlet ends of the second three-way pipe (6*b*) respectively communicate with the ice maker evaporator (3*a*) and the refrigerating chamber evaporator (3*b*), the outlet end of the second three-way pipe (6*b*) communicates with the inlet end of the compressor (1).

3. The refrigeration system of claim 1, wherein the condenser (2) communicates with the inlet end of the first three-way pipe (6*a*) through a filter (7).

4. The refrigeration system of claim 1, further comprising a third three-way pipe (6*c*) having an inlet end and two outlet ends, the inlet end of the third three-way pipe (6*c*) communicates with the outlet end of the compressor (1), and the two outlet ends of the third three-way pipe (6*c*) respectively communicate with the third solenoid valve (5*c*) and the condenser (2).

5. A wine cooler, comprising:

a machine housing (8) having a refrigerating chamber (8*a*) inside;

a door (81) disposed in front of the refrigerating chamber (8*a*) to cover the refrigerating chamber (8*a*);

an ice maker (9) located above the refrigerating chamber (8*a*); and the refrigeration system of claim 1 disposed inside the machine housing (8);

wherein, the ice maker evaporator (3*a*) of the refrigeration system is disposed inside the ice maker (9) and at a top of the ice maker (9), and the refrigerating chamber evaporator (3*b*) of the refrigeration system is disposed behind the refrigerating chamber (8*a*).

6. The wine cooler of claim 5, wherein the ice maker (9) comprises an ice containing drawer (91) capable of being extended or retracted, and a water storage box (92) capable of being turned over which is disposed above the ice containing drawer (91);

the ice maker evaporator (3a) is located above the water storage box (92), and the ice containing drawer (91) has one or more water leakage holes 91*a* at a bottom of the ice containing drawer (91).

7. The wine cooler of claim 5, wherein a partition plate (82) is disposed inside the refrigerating chamber (8*a*) to divide the refrigerating chamber (8*a*) into an upper area (8*a*1) for storing red wines and a lower area (8*a*2) for storing drinks.

8. The wine cooler of claim 5, wherein a functional module (10) is disposed above the refrigerating chamber (8*a*) inside the machine housing (8).

9. The wine cooler of claim 8, wherein the functional module (10) is a disinfection cabinet module.

10. The wine cooler of claim 9, wherein the disinfection cabinet module is a drawer cabinet.

11. The wine cooler of claim 8, wherein the functional module (10) is a cigar cabinet module.

* * * * *